US007269385B2

(12) United States Patent
Kimura et al.

(10) Patent No.: US 7,269,385 B2
(45) Date of Patent: Sep. 11, 2007

(54) SHEET GUIDE, FIXING DEVICE AND IMAGE FORMING APPARATUS

(75) Inventors: Kouichi Kimura, Ebina (JP); Ryuji Katsuno, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 138 days.

(21) Appl. No.: 11/192,266

(22) Filed: Jul. 29, 2005

(65) Prior Publication Data

US 2006/0210328 A1 Sep. 21, 2006

(30) Foreign Application Priority Data

Mar. 15, 2005 (JP) ..... 2005-072952

(51) Int. Cl.
*G03G 15/00* (2006.01)

(52) U.S. Cl. ..... 399/397; 399/381; 399/405

(58) Field of Classification Search ..... 399/322, 399/381, 397, 400, 401, 405; 271/8.1, 3.14, 271/278
See application file for complete search history.

(56) References Cited

U.S. PATENT DOCUMENTS 4,933,726 A * 6/1990 Moriyama ..... 399/405
5,043,759 A * 8/1991 Sakai ..... 399/178
5,837,366 A * 11/1998 Tanaka ..... 428/327
6,067,439 A * 5/2000 Kadokura et al. ..... 399/397 X
6,188,865 B1 * 2/2001 Kopp ..... 399/400
6,298,214 B1 * 10/2001 Koga ..... 399/322
6,542,711 B2 * 4/2003 Matsunai ..... 399/322
6,584,299 B2 * 6/2003 Nomura ..... 399/405

FOREIGN PATENT DOCUMENTS

JP 5-134513 (A) 5/1993
JP 2003-43834 (A) 2/2003
JP 2003-43836 (A) 2/2003
JP 2003-81505 (A) 3/2003

* cited by examiner

*Primary Examiner*—Sandra L. Brase
(74) *Attorney, Agent, or Firm*—Morgan, Lewis & Bockius LLP

(57) ABSTRACT

A sheet guide sheet guide for guiding a recording sheet includes an outermost surface layer brought into contact with a recording sheet, which is formed of a material having a water contact angle of approximately 50° or less and one of a pencil hardness of 9H or more and a Mohs hardness of 4 or more.

16 Claims, 4 Drawing Sheets

FIG. 5

| MATERIAL | MAIN COMPONENT | WATER CONTACT ANGLE |
|---|---|---|
| A | CERAMIC MATERIAL INCLUDING METAL OXIDE AS MAIN COMPONENT | 6° - 9° |
| B | CERAMIC MATERIAL INCLUDING METAL OXIDE AS MAIN COMPONENT | 16° - 19° |
| C | CERAMIC MATERIAL INCLUDING METAL OXIDE AS MAIN COMPONENT | 28° - 32° |
| D | CERAMIC MATERIAL INCLUDING METAL OXIDE AS MAIN COMPONENT | 54° - 55° |
| E | CERAMIC MATERIAL AS AQUEOUS METAL SALT AGENT | 38° - 40° |
| F | CERAMIC MATERIAL AS AQUEOUS METAL SALT AGENT | 47° - 50° |
| G | CERAMIC MATERIAL AS AQUEOUS METAL SALT AGENT | 72° - 74° |
| H | CERAMIC MATERIAL AS AQUEOUS METAL SALT AGENT | 85° - 88° |

◎ means no white spot occurs

○ means that white spots slightly occur on 1 or 2 sheets

△ means that white spots occur on 10 or less sheets

× means that white spots occur on 10 or more sheets

SHEET GUIDE, FIXING DEVICE AND IMAGE FORMING APPARATUS

BACKGROUND OF THE INVENTION

1. Field of the Invention

The present invention relates to a sheet guide which guides a recording sheet, and an image fixing device and an image forming apparatus having the sheet guide.

2. Description of the Related Art

Generally, in an electrophotographic-type image forming apparatus such as a copier, a printer and a facsimile machine, a fixing process is performed on a toner image formed on a recording sheet such as print paper by applying heat of more than 100° C., thereby image output onto the recording sheet is performed. In the case of image formation through the fixing process, if the recording sheet includes moisture, the moisture in the recording sheet is evaporated by the heat in the fixing process, and attached to a sheet guide to guide the recording sheet. If the amount of evaporation is large, the water vapor is condensed to water drops, and as a result, the water drops may wet the recording sheet or blur the image on the recording sheet. This phenomenon may frequently occur especially when an internal temperature of the apparatus or the temperature of the recording sheet is equal to that immediately after start-up of the apparatus (e.g., morning hours).

SUMMARY OF THE INVENTION

According to an aspect of the present invention, a sheet guide for guiding a recording sheet includes an outermost surface layer brought into contact with a recording sheet, which is formed of a material having a water contact angle of approximately 50° or less and one of a pencil hardness of 9H or more and a Mohs hardness of 4 or more.

BRIEF DESCRIPTION OF THE DRAWINGS

Embodiments of the present invention will be described in detail based on the following figures, wherein:

FIG. 5 is a table showing particular examples of ceramic materials used for coating of the sheet guide.

DETAILED DESCRIPTION OF THE INVENTION

Hereinbelow, a sheet guide, a fixing device and an image forming apparatus according to the present invention will be described in detail in accordance with the accompanying drawings.

First, the image forming apparatus will be described. The image forming apparatus of the embodiment is used as a copier, a printer or a facsimile machine. The image forming apparatus has an image forming unit, a fixing device and an inverter guide.

The image forming unit forms and outputs a toner image on a recording sheet. The recording sheet includes print paper such as normal paper and recycled paper, and further, OHP sheet and the like. Further, the toner image may be obtained by combining plural toner images of color components such as CMYK components. Note that as the details of the formation of toner image and combining of color components are similar to those in the conventional art, the explanations thereof will be omitted.

Figure 1:
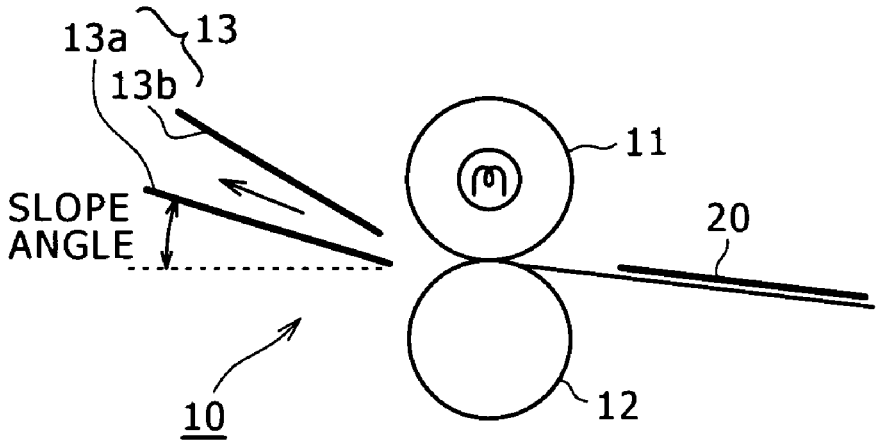
FIG. 1 is a schematic cross-sectional diagram showing an example of the configuration of a fixing device.

The fixing device performs a fixing process on a toner image formed on the recording sheet. As shown in FIG. 1, a fixing device 10 has a heating roller 11, a pressure roller 12 and a sheet guide 13. The fixing device 10 performs heating and pressurization on a recording sheet 20, on which a toner image is formed by the image forming unit, by holding the recording sheet 20 between the heating roller 11 and the pressure roller 12, thereby fixes the toner image onto the recording sheet 20. Further, the sheet guide 13 guides the recording sheet 20, subjected to a fixing process and output from the heating roller 11 and the pressure roller 12, to the inverter guide or an output tray (not shown). Note that the sheet guide 13 has a lower guide 13*a* for guidance on the lower surface side of the recording sheet 20 and an upper guide 13*b* for guidance on the upper surface side of the recording sheet 20.

Figure 2:
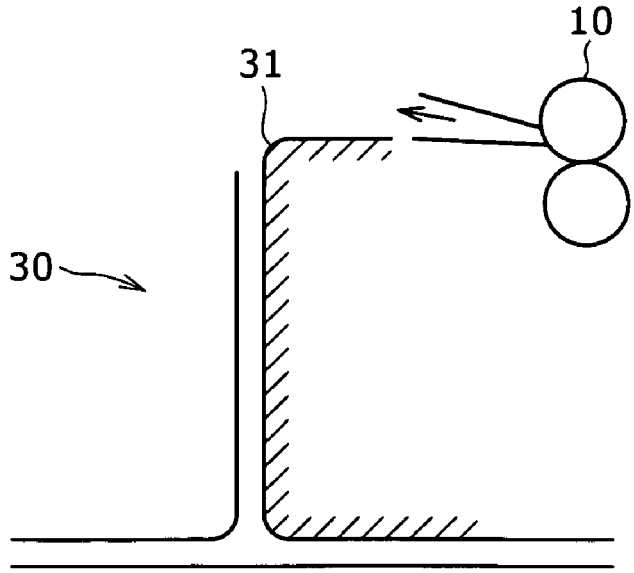
FIG. 2 is a schematic diagram showing an example of the configuration of an inverter guide.

The inverter guide is provided for double-sided printing on the recording sheet. The inverter guide receives the recording sheet 20 subjected to the fixing process by the fixing device 10, then inverts the sheet, and supplies the inverted recording sheet 20 to the image forming unit again. For this purpose, as shown in FIG. 2, an inverter guide 30 has a sheet guide 31 to guide the recording sheet 20 subjected to the fixing process and output from the fixing device 10, and a transport roller (not shown) to transport the recording sheet 20 along the sheet guide 31.

In the image forming apparatus having the above construction, when the image forming unit forms a toner image on the recording sheet 20, the recording sheet 20 is heated and pressurized between the heating roller 11 and the pressure roller 12 of the fixing device 10, thereby the toner image is fixed onto the recording sheet 20. At this time, if the recording sheet 20 includes moisture, as heat of more than 100° C. is applied by the fixing process, the moisture is evaporated and attached to the sheet guides 13 and 31. If the amount of evaporation is large, the water vapor may be condensed to water drops. The growth to water drops may occur due to the fixing process on plural recording sheets 20, depending on the thickness of the recording sheet 20, water content, apparatus operating status, environmental conditions (temperature and humidity) and the like. The water drops on the sheet guides 13 and 31 may wet the recording sheet 20 or blur the image formed on the recording sheet 20. That is, in the case of single-sided printing, fluctuating or deformation of the recording sheet 20 may occur. In the case of double-sided printing, as a toner image cannot be transferred to a portion where a water drop is attached, the defect such as white spots in the image occurs in addition to the fluctuating and deformation of recording sheet.

Figure 3:
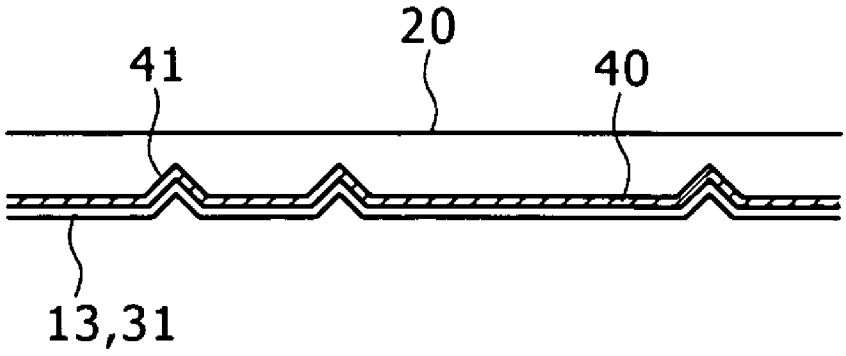
FIG. 3 is a schematic cross-sectional diagram showing the configuration of a sheet guide according to the present invention.

In consideration of the problems, as shown in FIG. 3, in the sheet guides 13 and 31 of the present embodiment, an outermost surface on the side in contact with the recording sheet 20 has a ceramic layer 40 formed by coating with a ceramic material to be described in detail later. In a case where the sheet guides 13 and 31 have ribs 41, the ceramic layer 40 is also formed on the ribs 41.

In the sheet guides 13 and 31, by virtue of the formation of the ceramic layer 40, a water contact angle of the outermost surface on the side in contact with the recording sheet 20 is 50° or smaller, and the sheet guides have pencil hardness of 9H or higher or Mohs hardness of 4 or higher, as described in detail later.

Figure 4:
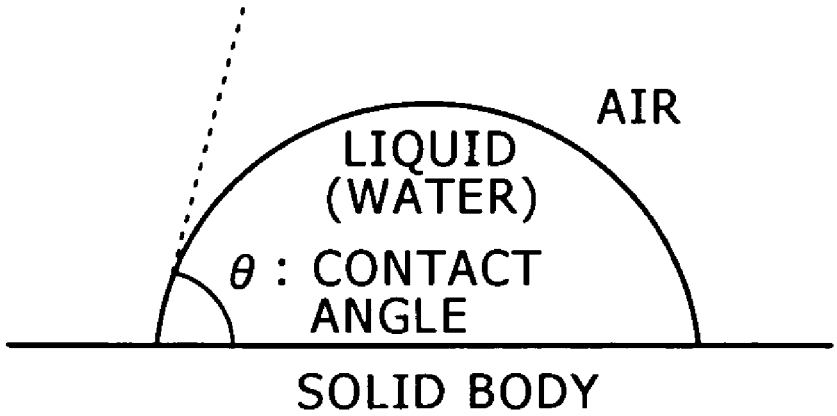
FIG. 4 is an explanatory diagram showing the conception of water contact angle.

As shown in FIG. 4, the water contact angle means an angle θ in the boundary between a solid body and liquid (water). The water contact angle represents water repellency, wettability or the like of the solid body. The greater the contact angle value is, the higher the water repellency level is.

Further, the pencil hardness and Mohs hardness both represent the hardness of the surface of the solid body. The pencil hardness represents the hardness of the surface of the solid body using pencil hardness (HB, 2H etc.) to scratch the surface of solid body. Further, the Mohs hardness represents the hardness of the surface of the solid body by numbering 10 sorts of minerals 10 to 1 sequentially from the hardest one.

In the sheet guides 13 and 31 having the above configuration, and the fixing device 10 and the image forming apparatus having the sheet guides 13 and 31, as the water contact angle of the outermost surface on the side in contact with the recording sheet 20 is 50° or smaller, the outermost surface has high wettability. For example, even if water vapor is attached to the outermost surface, the water vapor is not easily condensed. Accordingly, even when moisture in the recording sheet 20 is evaporated by the fixing process by the fixing device 10, the condensation of water vapor attached to the sheet guides 13 and 31 can be suppressed, and wetting of the recording sheet 20, blur of image formed on the recording sheet 20 or the like can be prevented. As a result, the occurrence of image defect such as white spots can be prevented, and excellent image forming quality can be realized. Further, as a fan or the like is not required, the complicacy and upsizing of the apparatus can be avoided.

In addition, the outermost surface of the sheet guides 13 and 31 on the side in contact with the recording sheet 20 has pencil hardness of 9H or higher or Mohs hardness of 4 or higher. Even if the outermost surface goes in contact with the recording sheet 20 upon transportation of the sheet, abrasion due to the contact does not easily occur, and a state of high wettability can be maintained. That is, as the outermost surface of the sheet guides 13 and 31 has high durability (especially, abrasion resistance), high persistence of the effect of suppression of water drop attachment to the sheet guides 13 and 31 can be attained, and long-term reliability can be ensured.

Note that in the sheet guides 13 and 31, as long as a water contact angle of the outermost surface on the side in contact with the recording sheet 20 is 50° or smaller and the sheet guides have pencil hardness of 9H or higher or Mohs hardness of 4 or higher, the sheet guides 13 and 31 themselves may be formed with a ceramic material without formation of the ceramic layer 40.

However, in the case of formation of ceramic layer 40, i.e., coating with a ceramic material, the flexibility to the shapes of sheet guides 13 and 31 can be sufficiently obtained. That is, the sheet guides 13 and 31, in any shape, can be easily coated with a ceramic material in comparison with the formation of the sheet guides themselves with the ceramic material. For example, even in a case where the sheet guides 13 and 31 have ribs 41 to reduce friction resistance upon transportation of the recording sheet 20, the sheet guides can be easily formed in correspondence with the above conditions at a low cost.

Further, the ceramic layer 40 is not necessarily formed over the entire area of the sheet guides 13 and 31. For example, in the sheet guide 13, the ceramic layer 40 may be formed on at least the lower guide 13*a* on the lower surface side of the recording sheet 20. Further, in the sheet guide 31, the ceramic layer 40 may be formed at least in an area where the recording sheet 20 holding the heat applied by the fixing device 10 is transported (hatched portion in FIG. 2, for example) on the lower surface side of the recording sheet 20.

Since the recording sheet 20 is guided, by its own weight, by mainly portions of the sheet guides 13 and 31 on the lower surface side, the wetting of the recording sheet 20 and the blur of image formed on the recording sheet 20 can be sufficiently prevented if the effect of suppression of water drop attachment is obtained in the portions on the lower surface side.

Further, as shown in FIG. 1, in the sheet guide 13, it is preferable that the lower guide 13*a* is inclined to a horizontal plane at an angle of 20° or greater. If the slope angle is equal to or greater than 20°, even when water vapor attached to the lower guide 13*a* is condensed to water drops, the water drops flow in the inclination direction. Thus the retention of water drops on the outermost surface of the lower guide 13*a* can be prevented. That is, the wetting of the recording sheet 20 and the like can be further prevented by the effect of suppression of water drop attachment by the ceramic layer 40 and the effect of suppression of water drop retention by the inclination.

EMBODIMENT 1

Next, a particular example of the sheet guides 13 and 31 having the above configuration will be described in detail.

In consideration of the above-described reasons, in the sheet guide 13, it is preferable that the material of the outermost surface on the side in contact with the recording sheet 20 has a small water contact angle and high hardness. As such materials of the outermost surface, ceramic materials as shown in FIG. 5 can be given. In the figure, materials A to D are mixtures of aluminum phosphate, silicon dioxide, zinc oxide, aluminum oxide and the like as ceramic materials including metallic oxides as main components. Material E, including silica (silicon dioxide) as a main component, is an aqueous metal salt ceramic material which functions as an aqueous metal salt coating agent. Material F, including silicon dioxide and aluminum oxide as main components, is an aqueous metal salt ceramic material which functions as an aqueous metal salt coating agent. Material G, including silicon dioxide, titanium oxide and calcium silicate as main components, is an aqueous metal salt ceramic material which functions as an aqueous metal salt coating agent. Material H, including silicon dioxide, titanium oxide and ferric oxide as main components, is an aqueous metal salt ceramic material which functions as an aqueous metal salt coating agent.

The water contact angles regarding these materials A to H are as follows. Regarding the material A, the water contact angle is 6° to 9°; regarding the material B, 16° to 19°; regarding the material C, 28° to 32°; regarding the material D, 54° to 55°; regarding the material E, 38° to 40°; regarding the material F, 47° to 50°; regarding the material G, 72° to 74°; and regarding the material H, 85° to 88°. The water contact angle is specified by dropping 1 to 2 μl of pure water on the sample in an ordinary temperature/ordinary humidity (e.g., 20° C.±5° C., 50 to 60% RT) atmosphere, and after the elapse of predetermined period (e.g., 30 sec), measuring a contact angle using an automatic measuring device including software to calculate 3 points (e.g., apex and both ends) of the water drop.

Further, as the materials A to H are ceramic materials, the ceramic layer 40 formed by coating the surface of the sheet guide 13 with these materials has pencil hardness of 9H or higher or Mohs hardness of 4 or higher.

Note that as a material having a small water contact angle, materials including surfactant can be given in addition to the ceramic materials. However, such a material has lower hardness, and the persistence of effect cannot be expected. Accordingly, such materials are not necessarily preferable as materials used on the surface of the sheet guide 13.

Figure 6:
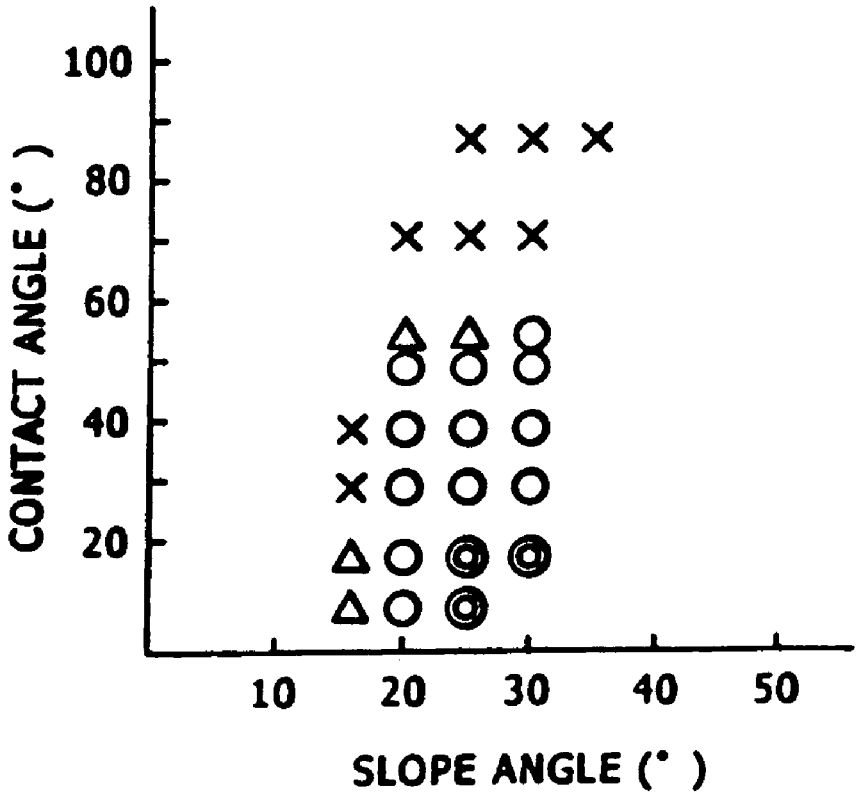
FIG. 6 is a graph showing an example of the result of evaluation of occurrence of white spot using the respective ceramic materials in FIG. 5.

FIG. 6 shows the result of examination in a case where the ceramic layer 40 is formed by coating the surface of the lower guide 13*a* of the sheet guide 13 with the above materials A to H, image formation is performed on the recording sheet 20 through the fixing process by the fixing device 10, and the status of occurrence of white spots as image defect on the recording sheet 20 are checked. Note that the inspection of image white spots is performed by continuously performing image formation on both sides of 500 sheets of quality paper having a considerable thickness (e.g., 209 g/m$^2$) for color image output. Further, an entire halftone (e.g., cyan 60% print) image is printed on the rear surface of the recording sheet such that the occurrence of white spots can be clearly detected. Further, the inspection of image white spots is performed while the slope angle of the sheet guide 13 is changed within a range of 15° to 35°. In the figure, the double circle means that no white spot occurs; the single circle means that white spots slightly occur on 1 or 2 sheets; the triangle means that white spots occur on 10 or less sheets; and the cross means that white spots occur on 10 or more sheets.

According to the result of examination in the figure, regarding the materials G and E having a water contact angle greater than 50°, white spots occur, but regarding the materials A to C, E and F having a water contact angle of 50° or smaller, the occurrence of white spot can be suppressed. It can be considered that the outermost surface of the lower guide 13*a* can effectively suppress attachment of water drops to the outermost surface if the water contact angle of the ceramic layer 40 is 50° or smaller.

Further, according to the result of examination in the figure, when the slope angle of the lower guide 13*a* is 15°, white spots occur, however, when the slope angle is 20° or greater, the occurrence of white spot can be suppressed. It can be considered that the lower guide 13*a* can effectively suppress attachment of water drops to the outermost surface if the lower guide 13*a* is inclined to a horizontal plane at an angle of 20° or greater.

Note that according to the result of examination in the figure, the occurrence of white spots can be completely suppressed if the ceramic layer 40 is formed with the material A or B, regarding which the water contact angle is 20° or smaller, and if the slope angle of the lower guide 13*a* having the ceramic layer 40 is 25° or greater (e.g., 25° or 30°). Accordingly, it is desirable that in the sheet guide 13, the water contact angle of the outermost surface of the lower guide 13*a* on the side in contact with the recording sheet 20 is 20° or smaller, and the guide has pencil hardness of 9H or higher or Mohs hardness of 4 or higher, and further, the angle to the horizontal plane is 25° or greater.

Further, in addition to the sheet guide 13 in the fixing device 10, in the sheet guide 31 in the in the inverter guide 30, if the ceramic layer 40 is formed in at least a portion where the recording sheet 20 holding the heat applied by the fixing device 10 is transported (e.g., hatched portion in FIG. 2) on the lower surface side of the recording sheet 20, thereby the water contact angle is 50° or smaller, and the portion has pencil hardness of 9H or higher or Mohs hardness of 4 or higher, or further preferably, the water contact angle is 20° or smaller and the portion has pencil hardness of 9H or higher or Mohs hardness of 4 or higher, the occurrence of white spots as an image defect can be effectively suppressed. Although the influence of this guide is smaller in comparison with that of the sheet guide 13 in the fixing device 10, white spots occur on about 50 recording sheets of 500 sheets if the inverter guide does not have the ceramic layer 40. On the other hand, if the ceramic layer 40 is formed, no white spot occurs or slightly occurs on 1 or 2 recording sheets.

As described above, according to an aspect of the present invention, a sheet guide for guiding a recording sheet includes an outermost surface layer brought into contact with a recording sheet, which is formed of a material having a water contact angle of approximately 50° or less and one of a pencil hardness of 9H or more and a Mohs hardness of 4 or more.

The outermost surface layer may be a coating of a ceramic material. The ceramic material may include a metal oxide or an aqueous metal salt as a main component.

The sheet guide may be provided beneath the recording sheet.

The sheet guide may be inclined with respect to a horizontal plane at an angle of approximately 20° or more.

According to another aspect of the present invention, a sheet guide for guiding a recording sheet includes an outermost surface layer brought into contact with a recording sheet, which is formed of a material having a water contact angle of approximately 20° or less and one of a pencil hardness of 9H or more and a Mohs hardness of 4 or more.

The outermost surface layer may be a coating of a ceramic material. The ceramic material may include a metal oxide or an aqueous metal salt as a main component.

The sheet guide may be provided beneath the recording sheet.

The sheet guide may be inclined with respect to a horizontal plane at an angle of approximately 20° or more.

According to further aspect of the present invention, a fixing device includes an image fixing unit that performs a fixing process on a toner image formed on a recording sheet, and a sheet guide that guides the recording sheet subjected to the fixing process and exited from the image fixing unit. The sheet guide includes an outermost surface layer brought into contact with a recording sheet, which is formed of a material having a water contact angle of approximately 50° or less and one of a pencil hardness of 9H or more and a Mohs hardness of 4 or more.

According to further aspect of the present invention, an image forming apparatus includes an image forming unit that forms a toner image on a recording sheet, an image fixing unit that performs a fixing process on the toner image formed on the recording sheet, and a sheet guide that guides the recording sheet subjected to the fixing process and exited from the image fixing unit. The sheet guide includes an outermost surface layer brought into contact with a recording sheet, which is formed of a material having a water contact angle of approximately 50° or less and one of a pencil hardness of 9H or more and a Mohs hardness of 4 or more.

According to further aspect of the present invention, a fixing device includes an image fixing unit that performs a fixing process on a toner image formed on a recording sheet, and a sheet guide that guides the recording sheet subjected to the fixing process and exited from the image fixing unit. The sheet guide includes an outermost surface layer brought into contact with a recording sheet, which is formed of a material having a water contact angle of approximately 20° or less and one of a pencil hardness of 9H or more and a Mohs hardness of 4 or more.

According to further aspect of the present invention, an image forming apparatus includes an image forming unit that forms a toner image on a recording sheet, an image fixing unit that performs a fixing process on the toner image formed on the recording sheet, and a sheet guide that guides the recording sheet subjected to the fixing process and exited from the image fixing unit. The sheet guide includes an outermost surface layer brought into contact with a recording sheet, which is formed of a material having a water contact angle of approximately 20° or less and one of a pencil hardness of 9H or more and a Mohs hardness of 4 or more.

As described above, in the sheet guide, the fixing device and the image forming apparatus having the above configurations, as condensation of water vapor into water drops does not easily occur on the outermost surface of the sheet guide on the side in contact with a recording sheet, wetting of the recording sheet or blur of image on the recording sheet can be prevented. As a result, the occurrence of an image defect such as white spots can be prevented, and an excellent image formation quality can be realized. Further, as a fan or the like is not required, complicacy of the apparatus construction or upsizing of the apparatus is not caused. Further, as the outermost surface has high durability (especially abrasion resistance), high persistence of the effect of suppression of water drop attachment to the sheet guide can be attained, and long-term reliability can be ensured.

Note that in the above-described embodiment, one example of implementation of the present invention is described, however, the present invention is not limited to the contents of the embodiment. It is apparent that appropriate changes can be made without departing from the spirit and scope thereof.

The entire disclosure of Japanese Patent Application No. 2005-072952 filed on Mar. 15, 2005 including specification, claims, drawings and abstract is incorporated herein by reference in its entirety.

What is claimed is:

1. A sheet guide for guiding a recording sheet, comprising:

an outermost surface layer brought into contact with a recording sheet, which is formed of a material having a water contact angle of approximately 50° or less and one of a pencil hardness of 9H or more and a Mohs hardness of 4 or more.

2. The sheet guide according to claim 1, wherein the outermost surface layer is a coating of a ceramic material.

3. The sheet guide according to claim 2, wherein the ceramic material includes a metal oxide as a main component.

4. The sheet guide according to claim 2, wherein the ceramic material includes an aqueous metal salt as a main component.

5. The sheet guide according to claim 1, wherein the sheet guide is provided beneath the recording sheet.

6. The sheet guide according to claim 1, wherein the sheet guide is inclined with respect to a horizontal plane at an angle of approximately 20° or more.

7. A sheet guide for guiding a recording sheet, comprising:

an outermost surface layer brought into contact with a recording sheet, which is formed of a material having a water contact angle of approximately 20° or less and one of a pencil hardness of 9H or more and a Mohs hardness of 4 or more.

8. The sheet guide according to claim 7, wherein the outermost surface layer is a coating of a ceramic material.

9. The sheet guide according to claim 8, wherein the ceramic material includes a metal oxide as a main component.

10. The sheet guide according to claim 8, wherein the ceramic material includes an aqueous metal salt as a main component.

11. The sheet guide according to claim 7, wherein the sheet guide is provided beneath the recording sheet.

12. The sheet guide according to claim 7, wherein the sheet guide is inclined with respect to a horizontal plane at an angle of approximately 20° or more.

13. A fixing device comprising:

an image fixing unit that performs a fixing process on a toner image formed on a recording sheet; and a sheet guide that guides the recording sheet subjected to the fixing process and exited from the image fixing unit, the sheet guide comprising an outermost surface layer brought into contact with a recording sheet, which is formed of a material having a water contact angle of approximately 50° or less and one of a pencil hardness of 9H or more and a Mohs hardness of 4 or more.

14. An image forming apparatus comprising:

an image forming unit that forms a toner image on a recording sheet;

an image fixing unit that performs a fixing process on the toner image formed on the recording sheet; and a sheet guide that guides the recording sheet subjected to the fixing process and exited from the image fixing unit, the sheet guide comprising an outermost surface layer brought into contact with a recording sheet, which is formed of a material having a water contact angle of approximately 50° or less and one of a pencil hardness of 9H or more and a Mohs hardness of 4 or more.

15. A fixing device comprising:

an image fixing unit that performs a fixing process on a toner image formed on a recording sheet; and a sheet guide that guides the recording sheet subjected to the fixing process and exited from the image fixing unit, the sheet guide comprising an outermost surface layer brought into contact with a recording sheet, which is formed of a material having a water contact angle of approximately 20° or less and one of a pencil hardness of 9H or more and a Mohs hardness of 4 or more.

16. An image forming apparatus comprising:

an image forming unit that forms a toner image on a recording sheet;

an image fixing unit that performs a fixing process on the toner image formed on the recording sheet; and a sheet guide that guides the recording sheet subjected to the fixing process and exited from the image fixing unit, the sheet guide comprising an outermost surface layer brought into contact with a recording sheet, which is formed of a material having a water contact angle of approximately 20° or less and one of a pencil hardness of 9H or more and a Mohs hardness of 4 or more.

* * * * *